US012188339B2

(12) United States Patent
Ma et al.

(10) Patent No.: US 12,188,339 B2
(45) Date of Patent: Jan. 7, 2025

(54) HYDRAULIC FRACTURING AND CUTTING COOPERATIVE DEVICE SUITABLE FOR HARD ROCK AND USE METHOD THEREOF

(71) Applicant: CHINA UNIVERSITY OF MINING AND TECHNOLOGY, Xuzhou (CN)

(72) Inventors: Dan Ma, Xuzhou (CN); Qiang Li, Xuzhou (CN); Wentao Hou, Xuzhou (CN); Zhenhua Li, Xuzhou (CN); Yuanbo Xue, Xuzhou (CN); Xuefeng Gao, Xuzhou (CN); Kuirun Zhang, Xuzhou (CN); Weihao Huang, Xuzhou (CN); Zaixing Zu, Xuzhou (CN); Hao Wu, Xuzhou (CN); Hao Yan, Xuzhou (CN)

(73) Assignee: CHINA UNIVERSITY OF MINING AND TECHNOLOGY, Xuzhou (CN)

( * ) Notice: Subject to any disclaimer, the term of this patent is extended or adjusted under 35 U.S.C. 154(b) by 0 days.

(21) Appl. No.: 18/636,666

(22) Filed: Apr. 16, 2024

(65) Prior Publication Data

US 2024/0392669 A1 Nov. 28, 2024

(30) Foreign Application Priority Data

May 26, 2023 (CN) ..... 202310602752.4

(51) Int. Cl.
*E21B 43/114* (2006.01)
*E21B 4/02* (2006.01)
*E21B 43/26* (2006.01)

(52) U.S. Cl.
CPC ..... *E21B 43/26* (2013.01); *E21B 4/02* (2013.01)

(58) Field of Classification Search
CPC ..... E21B 43/26; E21B 43/114
See application file for complete search history.

(56) References Cited

U.S. PATENT DOCUMENTS 2,758,653 A * 8/1956 Desbrow ..... E21B 43/26 166/308.1
3,613,805 A * 10/1971 Lindstad ..... E21B 21/08 173/4

(Continued)

FOREIGN PATENT DOCUMENTS

AU 2013330947 4/2016
CN 102071921 A 5/2011

(Continued)

OTHER PUBLICATIONS

Office action for China Application No. 202310602752.4, mailed Sep. 4, 2023.

(Continued)

*Primary Examiner* — Kenneth L Thompson
(74) *Attorney, Agent, or Firm* — Pilloff Passino & Cosenza LLP; Rachel Pilloff; Sean Passino

(57) ABSTRACT

Disclosed are a hydraulic fracturing and cutting cooperative device suitable for a hard rock and a use method thereof, belonging to the technical field of high-efficiency and rapid excavation of hard rock roadway (tunnel). The hydraulic fracturing and cutting cooperative device suitable for a hard rock provided by the disclosure includes a drill pipe, a pneumatic drilling system, a hydraulic fracturing system, a collaborative control system and a cutting head.

8 Claims, 5 Drawing Sheets

(56) References Cited

U.S. PATENT DOCUMENTS

| | | | | | |
|---|---|---|---|---|---|
| 5,624,209 | A * | 4/1997 | Melegari | E21B 17/18 | 405/269 |
| 6,834,720 | B1 * | 12/2004 | Dwyer | E21B 33/138 | 166/290 |
| 8,171,659 | B2 * | 5/2012 | Hursen | E02F 3/9206 | 37/195 |
| 8,567,523 | B2 * | 10/2013 | Stacy, II | E21B 7/00 | 175/57 |
| 9,347,301 | B2 * | 5/2016 | Gao | E21B 43/26 | |

FOREIGN PATENT DOCUMENTS

| | | | | | |
|---|---|---|---|---|---|
| CN | 102852506 | A | | 1/2013 | |
| CN | 103195468 | A | | 7/2013 | |
| CN | 104989356 | A | | 10/2015 | |
| CN | 105089525 | A | | 11/2015 | |
| CN | 105525900 | A | | 4/2016 | |
| CN | 218912845 | U | | 4/2023 | |
| CN | 116411964 | B | * | 1/2024 | E21C 25/60 |

OTHER PUBLICATIONS

Notice to Grant Patent for China Application No. 202310602752.4, mailed Oct. 7, 2023.
First Search Report for China Application No. 202310602752.4, dated Sep. 1, 2023.
Supplementary Search Report for China Application No. 202310602752.4, dated Sep. 27, 2023.

* cited by examiner

HYDRAULIC FRACTURING AND CUTTING COOPERATIVE DEVICE SUITABLE FOR HARD ROCK AND USE METHOD THEREOF

CROSS-REFERENCE TO RELATED APPLICATIONS

This application claims priority to Chinese Patent Application No. 202310602752.4, filed on May 26, 2023, the contents of which are hereby incorporated by reference.

TECHNICAL FIELD

The disclosure belongs to the technical field of high-efficiency rapid excavation of hard rock roadway (tunnel), and in particular to a hydraulic fracturing and cutting cooperative device suitable for a hard rock and a use method thereof.

BACKGROUND

As a main energy source in our strategic energy and industrial raw materials, and will remain a cornerstone of the long-term stable development of the national economy in the future. With an increasing human demand for energy and mining intensity, shallow resources in most areas are increasingly depleted, and mines at home and abroad are gradually entering a state of deep mining. Due to complex geological structures of deep strata, hard rock roadways are often encountered in coal mining and excavation. A level of rock roadway excavation with a drilling and blasting method is maintained at 70 m-80 m/month all the year round, which leads to a low excavation efficiency and a tense relationship between excavation and replacement. A situation faced by metal mines is even more severe. There are 112 foreign metal mines with mining depths of more than 1000 m, of which 16 mines have mining depths of more than 3000 m (12 are in South Africa, all of which are gold mines). At present, there are 16 metal mines with mining depths below 1000 m in our country (including 8 gold mines and 7 non-ferrous metal mines), and strengths of the contacted rocks during roadway excavation are greater. Especially when a Proctor's coefficient f>6, there are some problems in rock roadway excavation, such as slow advancing speed, large resource consumption and high excavation cost. Therefore, a contradiction between difficulty of hard rock roadway excavation and an increase of energy demand is increasingly prominent, which is a major problem to be solved urgently.

Aiming at the difficulty of deep underground hard rock roadway excavation, many researchers began to optimize and adjust the whole rock roadway excavation equipment and technology. Rock breaking by drilling and blasting has always been a dominant method of roadway excavation and mining in hard rock mines, and the blasting technology has been optimized in recent years. This method has main advantages of quick operation preparation, strong adaptability to rocks, flexible movement and easy handling when encountering geological faults and technical faults. However, there are still some shortcomings, such as low average excavation speed, difficulty in organizing cross-operations among multiple processes, serious harm of blasting smoke and high risk.

Therefore, in order to solve the hazards and shortcomings of blasting mining, mechanized mining technology of hard rock underground mines has gradually become a focus of researchers' research. Researchers have summarized types of equipment for mechanized continuous mining of underground hard rock, which are divided into drilling equipment, cutting disc roadheader, rotary drum cutting disc roadheader and cantilever drift roadheader. In recent years, a structure of cutter head used in the roadheader in our country has been continuously improved, and a material has been continuously optimized, promoting an overall performance of the roadheader to be continuously improved and greatly optimizing the hard rock excavation equipment and process technology. However, in order to achieve efficient excavation in hard rock roadway, it is difficult to achieve good excavation effect only by unilaterally optimizing the structure of cutter head. There is a need to change mechanical properties of hard rock itself in the roadway, that is, to improve the working efficiency of roadheader by changing the structure and strength of rock and rock mass under a condition that the performance of roadheader remains unchanged.

At present, the efficient hard rock roadway excavation technology is to pre-treat the rock mass and then assist the mechanized cutting of broken rock. Hydraulic-fracturing-assisted mechanical rock breaking has particularly significant effects and is a widely used and comprehensive fracturing technology, which has been successfully applied in fields such as shale oil and tight oil and gas. A conventional hydraulic fracturing excavation method needs to use a drilling rig to drill a hydraulic fracturing hole in the hard rock, then move hydraulic fracturing equipment to fracture the hard rock, remove the hydraulic fracturing equipment after fracturing, and push the roadheader to a working face for excavation.

However, this conventional hydraulic fracturing method is time-consuming and laborious, and it is necessary to improve and optimize the excavation equipment of hard rock roadway (tunnel), so as to achieve a goal of integrating hydraulic fracturing and excavation of hard rock.

SUMMARY

An object of the disclosure is to provide a hydraulic fracturing and cutting cooperative device suitable for a hard rock and a use method thereof, so as to solve problems existing in the prior art.

In order to achieve the above purpose, the disclosure provides a hydraulic fracturing and cutting cooperative device suitable for a hard rock, including:

- a drill pipe, where the drill pipe is an integrated drill pipe for hydraulic fracturing and drilling, and one end of the drill pipe is detachably connected with a conical drill bit;
- a pneumatic drilling system, where the pneumatic drilling system is used for generating high-pressure gas and driving the drill pipe to drill holes;
- a hydraulic fracturing system, where the hydraulic fracturing system is communicated with the drill pipe and is used for providing a high-pressure fracturing fluid;
- a collaborative control system, where the pneumatic drilling system and the hydraulic fracturing system are both communicated with the collaborative control system, and the collaborative control system is used for realizing mutual conversion of a pneumatic drilling function and a hydraulic fracturing function of the drill pipe; and
- a cutting head, where the cutting head is installed on a roadheader, the drill pipe is coaxially sleeved in a middle of the cutting head, and the pneumatic drilling system is in transmission fit with the cutting head.

In an embodiment, the collaborative control system includes a gas-liquid pressurization speed-up box and a gas-liquid separation conversion chamber; the gas-liquid pressurization speed-up box is fixedly installed on a console of the roadheader, and the pneumatic drilling system and the hydraulic fracturing system are both communicated with the gas-liquid pressurization speed-up box; the drill pipe is communicated with the gas-liquid separation conversion chamber, and the gas-liquid separation conversion chamber is used for realizing the mutual conversion of the pneumatic drilling function and the hydraulic fracturing function of the drill pipe, and both the pneumatic drilling system and the hydraulic fracturing system are communicated with the gas-liquid separation conversion chamber.

In an embodiment, the pneumatic drilling system includes a high-pressure pneumatic motor; the high-pressure pneumatic motor is used for generating high-pressure gas, and the high-pressure pneumatic motor is fixedly installed at a bottom of an inner side of the gas-liquid pressurization speed-up box; one side, close to the gas-liquid separation conversion chamber, of the high-pressure pneumatic motor and a top of the high-pressure pneumatic motor are fixedly communicated with high-pressure air outlet pipes respectively, and the high-pressure air outlet pipes are provided with control valves; and one, close to the gas-liquid separation conversion chamber, of the high-pressure air outlet pipes at the one side of the high-pressure pneumatic motor is communicated with the gas-liquid separation conversion chamber; one side, away from the high-pressure pneumatic motor, of the gas-liquid separation conversion chamber is communicated with a power engine, and the drill pipe and the cutting head are both in transmission fit with the power engine.

In an embodiment, a top of the roadheader is fixedly connected with a metal bracket protective shell, the gas-liquid separation conversion chamber, the gas-liquid pressurization speed-up box and the console are all arranged in the metal bracket protective shell, and the power engine is fixedly installed on the metal bracket protective shell.

In an embodiment, the high-pressure pneumatic motor includes a central shaft; an outer side of the central shaft is sequentially sleeved with a power core and a rotating outer ring, and the central shaft includes a low-pressure air inlet and a high-pressure air outlet. Gas is rapidly compressed by a rotary motion of the power core and discharged through the high-pressure air outlet.

In an embodiment, the hydraulic fracturing system includes a high-pressure water pump box; a water pressure loader is arranged in the high-pressure water pump box, and a water pressure monitor is fixedly connected to a top outer wall of the high-pressure water pump box, and the water pressure monitor is used for monitoring a water pressure value lifted by the water pressure loader; the high-pressure water pump box is communicated with the gas-liquid separation conversion chamber through a high-pressure water pipeline, and the gas-liquid pressurization speed-up box is fixedly installed on the high-pressure water pipeline.

In an embodiment, the cutting head is provided with a connecting shaft, and the power engine is in transmission fit with the cutting head through the connecting shaft; an angle adjusting part is arranged between the power engine and the cutting head for controlling a cutting angle of the cutting head.

In an embodiment, the angle adjusting part includes a fixed shaft fixedly installed at a top of the power engine; a top end of the fixed shaft is provided with a pin hole, the fixed shaft is hinged with a rocker through the pin hole, and a hinged telescopic cylinder is arranged inside the rocker; a fixed end of the hinged telescopic cylinder is fixedly connected with the rocker, and a moving end of the hinged telescopic cylinder is hinged with the cutting head; a middle part of the rocker is hinged with a fixed telescopic cylinder, and an end of the fixed telescopic cylinder is fixedly connected with the power engine.

The disclosure further provides a use method of the hydraulic fracturing and cutting cooperative device suitable for a hard rock, which includes following steps:

S1, generating high-pressure gas by the high-pressure pneumatic motor to drive the drill pipe to drill into a hard rock to form a hydraulic fracturing borehole;

S2, adjusting one of the control valves at the gas-liquid separation conversion chamber to realize a mutual switching between the pneumatic drilling function and the hydraulic fracturing function of the drill pipe;

S3, providing the high-pressure fracturing fluid through the high-pressure water pump box;

S4, when the fracturing fluid flows through the gas-liquid pressurization speed-up box, further increasing a pressure of the fracturing fluid by the high-pressure pneumatic motor; and S5, adjusting an angle of the cutting head to perform omni-directional fracturing, and cutting a fractured rock mass.

Compared with the prior art, the disclosure has following advantages and technical effects.

According to the disclosure, the hydraulic fracturing function of the high-pressure water pump box is combined with the drilling function of the pneumatic engine through the gas-liquid separation conversion chamber and the gas-liquid pressurization speed-up box. After the hard rock is fractured, the hard rock is cut in all directions by adjusting the angle and an excavation depth of the cutting head, reducing work steps of hard rock excavation and truly enabling a hard rock excavation process to be an integrated process. The whole process is completed by the single equipment, thereby achieving a purpose of safe, continuous and efficient mining. The disclosure overcomes problems of slow excavation speed, low efficiency and many procedures of conventional hard rock fracturing, and improves a mining efficiency of the hard rock.

BRIEF DESCRIPTION OF THE DRAWINGS

In order to explain embodiments of the disclosure or a technical scheme in the prior art more clearly, drawings needed in the embodiments will be briefly introduced below. Apparently, the drawings described below are only some embodiments of the disclosure, and other drawings may be obtained according to these drawings without creative efforts for ordinary people in the field.

DETAILED DESCRIPTION OF THE EMBODIMENTS

Figure 1:
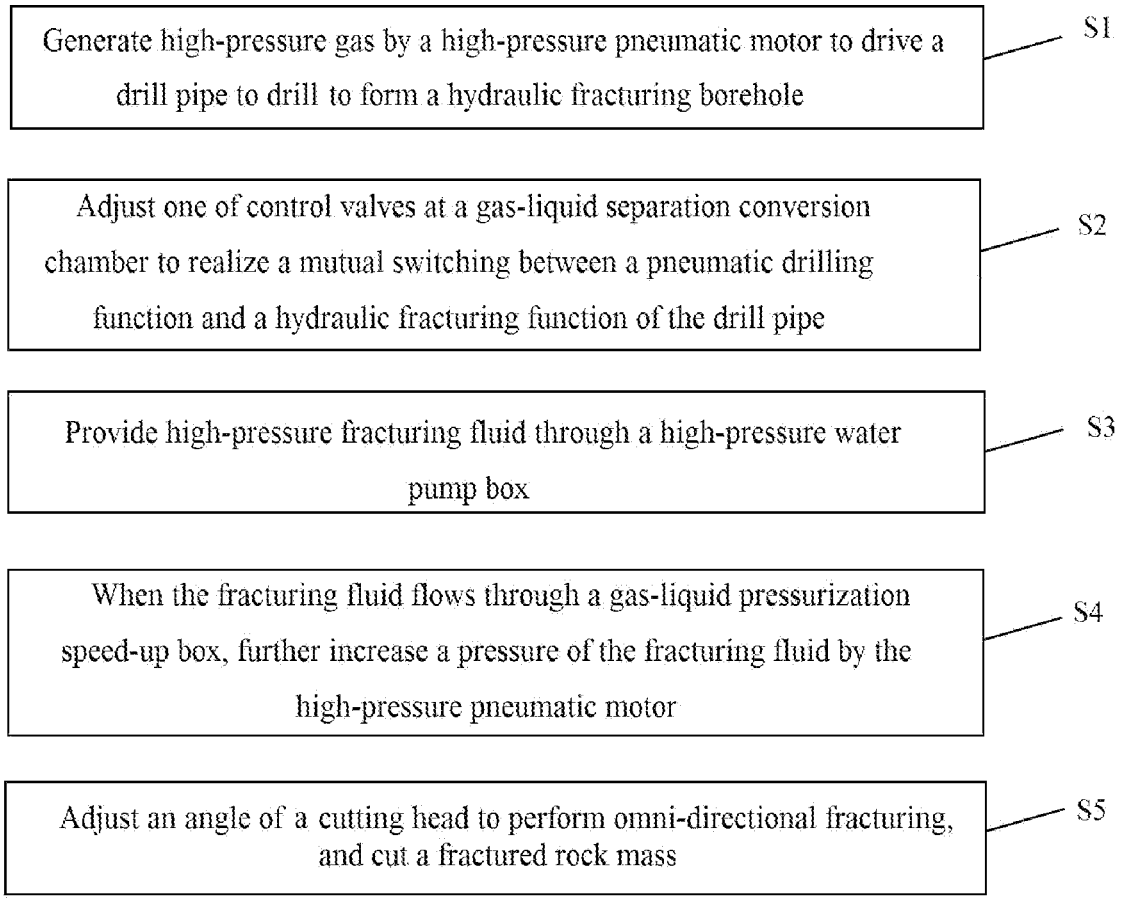
FIG. 1 is a flow chart of a use method of a hydraulic fracturing and cutting cooperative device suitable for a hard rock in the disclosure.
Figure 2:
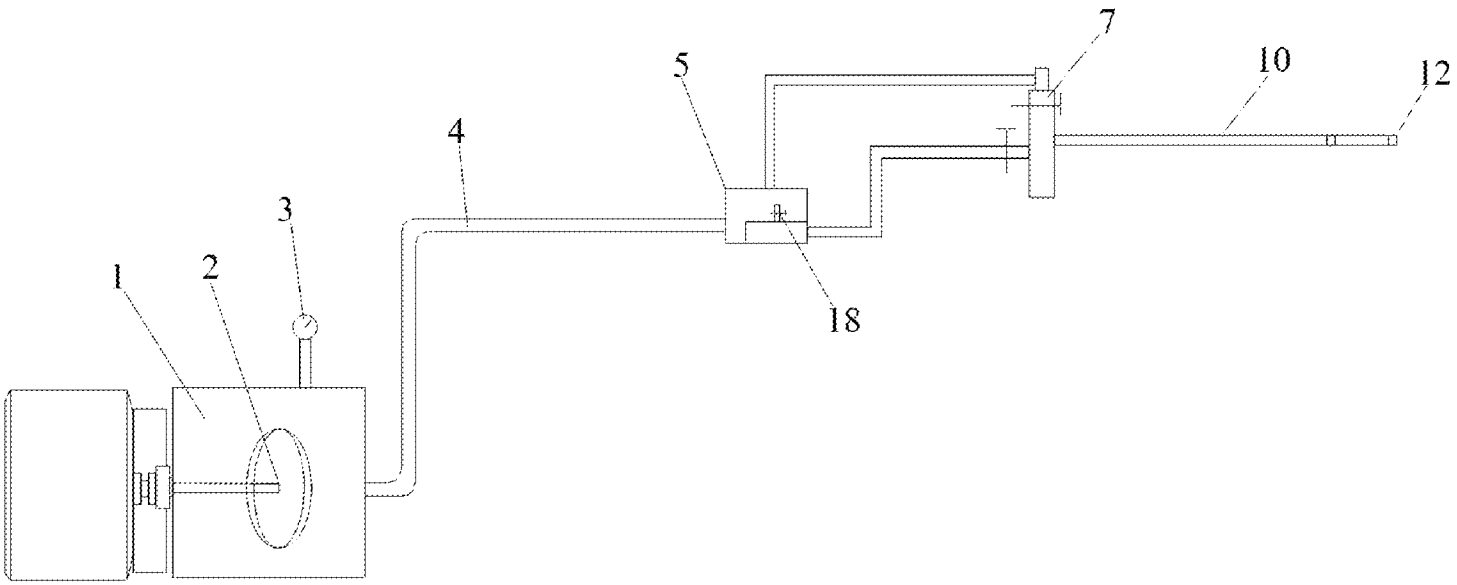
FIG. 2 is a schematic diagram of the hydraulic fracturing and cutting cooperative device suitable for a hard rock in the disclosure.
Figure 3:
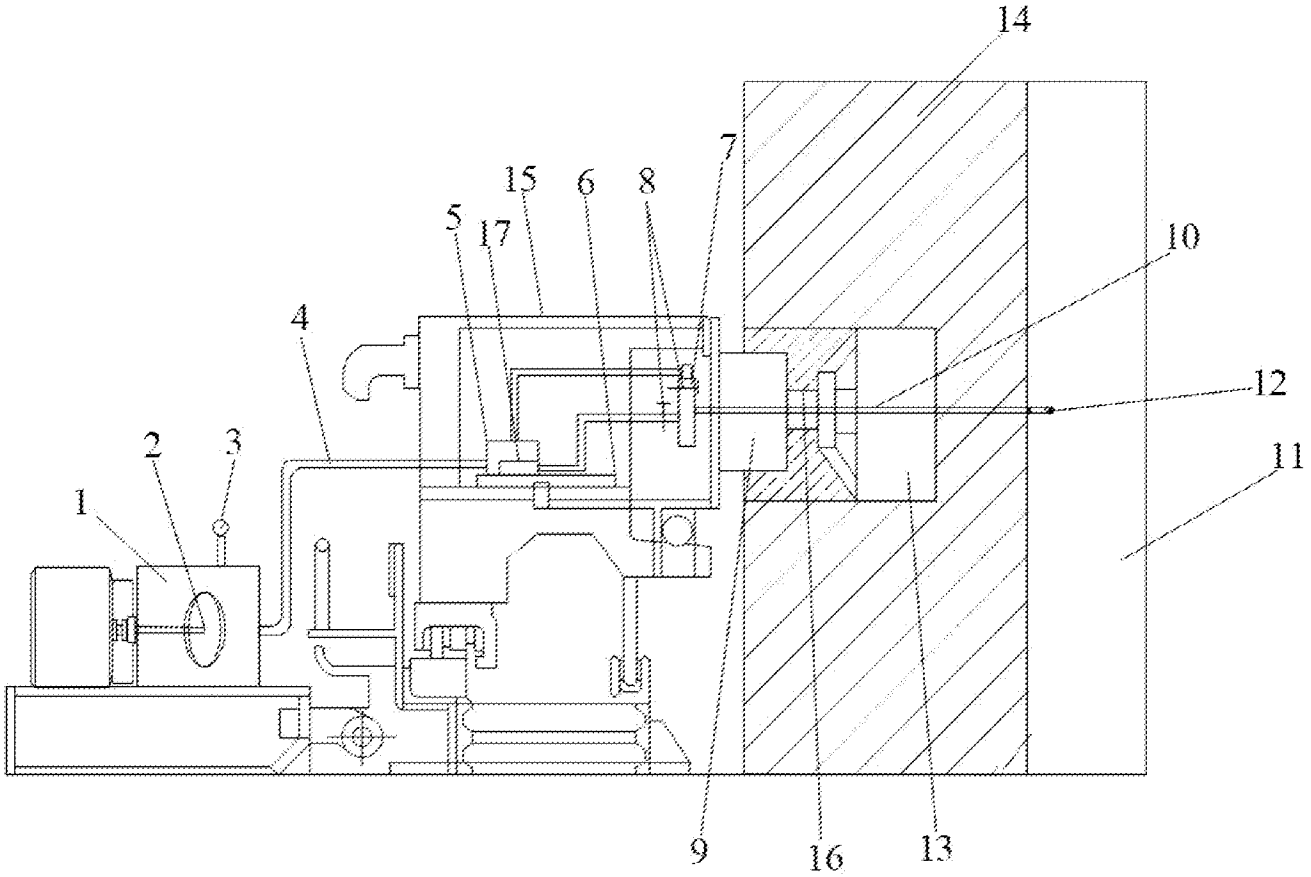
FIG. 3 is a detailed schematic structural diagram of the hydraulic fracturing and cutting cooperative device suitable for a hard rock placed in a complete roadheader in the disclosure.
Figure 4:
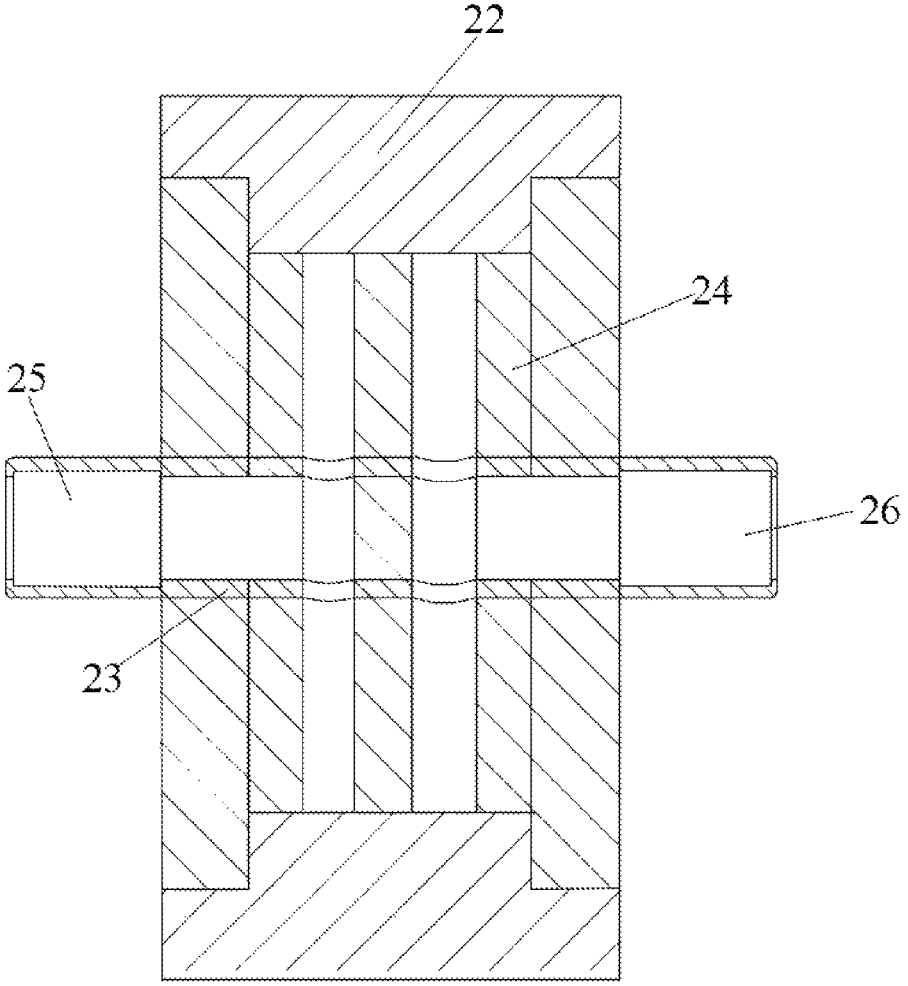
FIG. 4 is a schematic diagram of a high-pressure pneumatic motor of the hydraulic fracturing and cutting cooperative device suitable for a hard rock in the disclosure.
Figure 5:
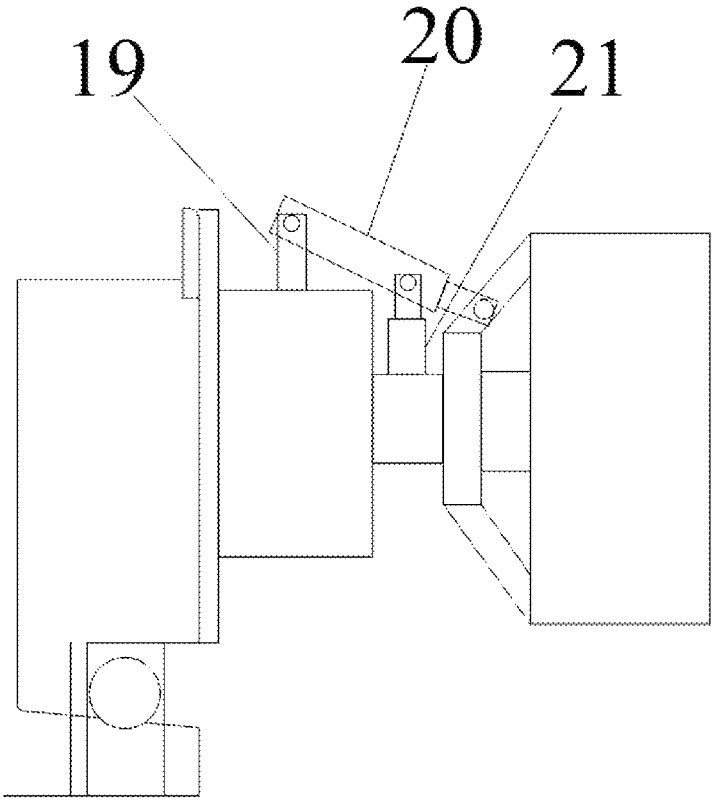
FIG. 5 is a schematic diagram of a cutting head of the hydraulic fracturing and cutting cooperative device suitable for a hard rock in the disclosure.

It should be noted that embodiments in the disclosure and features in the embodiments may be combined with each other without conflict. The described embodiments are only a part of embodiments of the disclosure, not all the embodiments. All other embodiments obtained by ordinary people in the field without creative efforts belong to a protection scope of the disclosure. The disclosure will be described in detail with reference to attached drawings and the embodiments.

As shown in FIGS. 2 to 5, a hydraulic fracturing and cutting cooperative device suitable for a hard rock provided in the embodiment includes:

- a drill pipe 10, where the drill pipe 10 is an integrated drill pipe for hydraulic fracturing and drilling, and one end of the drill pipe 10 is detachably connected with a conical drill bit 12;
- a pneumatic drilling system, where the pneumatic drilling system is used for generating high-pressure gas and driving the drill pipe 10 to drill holes;
- a hydraulic fracturing system, where the hydraulic fracturing system is communicated with the drill pipe 10 and is used for providing a high-pressure fracturing fluid;
- a collaborative control system, where the pneumatic drilling system and the hydraulic fracturing system are both communicated with the collaborative control system, and the collaborative control system is used for realizing mutual conversion of a pneumatic drilling function and a hydraulic fracturing function of the drill pipe 10; and
- a cutting head 13, where the cutting head 13 is installed on a roadheader, the drill pipe 10 is coaxially sleeved in a middle of the cutting head 13, and the pneumatic drilling system is in transmission fit with the cutting head 13.

According to the disclosure, three steps of drilling, hydraulic fracturing and hard rock excavation are integrated into a complete flow through the hydraulic fracturing and cutting cooperative device, so that a safe mining efficiency of hard rock excavation is obviously improved.

In an embodiment, the collaborative control system includes a gas-liquid pressurization speed-up box 5 and a gas-liquid separation conversion chamber 7, where the gas-liquid pressurization speed-up box 5 is fixedly installed on a console 6 of the roadheader, and the console 6 may adjust a cutting height by lifting. Both the pneumatic drilling system and the hydraulic fracturing system are communicated with the gas-liquid pressurization speed-up box 5. The drill pipe 10 is communicated with the gas-liquid separation conversion chamber 7, and the gas-liquid separation conversion chamber 7 is used to realize the mutual conversion of the pneumatic drilling function and the hydraulic fracturing function of the drill pipe 10, and both the pneumatic drilling system and the hydraulic fracturing system are communicated with the gas-liquid separation conversion chamber 7.

In an embodiment, the pneumatic drilling system includes a high-pressure pneumatic motor 17, where the high-pressure pneumatic motor 17 is used for generating high-pressure gas, and the high-pressure pneumatic motor 17 is fixedly installed at a bottom of an inner side of the gas-liquid pressurization speed-up box 5. One side, close to the gas-liquid separation conversion chamber 7, of the high-pressure pneumatic motor 17 and a top of the high-pressure pneumatic motor 17 are fixedly communicated with high-pressure air outlet pipes 18 respectively, and the high-pressure air outlet pipes 18 are provided with control valves 8 respectively. One, close to the gas-liquid separation conversion chamber 7, of the high-pressure air outlet pipes 18 at the one side of the high-pressure pneumatic motor 17 is communicated with the gas-liquid separation conversion chamber 7. One side, away from the high-pressure pneumatic motor 17, of the gas-liquid separation conversion chamber 7 is communicated with a power engine 9, and the drill pipe 10 and the cutting head 13 are both in transmission fit with the power engine 9.

In an embodiment, a top of the roadheader is fixedly connected with a metal bracket protective shell 15. The gas-liquid separation conversion chamber 7, the gas-liquid pressurization speed-up box 5 and the console 6 are all arranged in the metal bracket protective shell 15, and the power engine 9 is fixedly installed on the metal bracket protective shell 15.

In an embodiment, the high-pressure pneumatic motor 17 includes a central shaft 23, where an outer side of the central shaft 23 is sequentially sleeved with a power core 24 and a rotating outer ring 22. And the central shaft 23 includes a low-pressure air inlet 25 and a high-pressure air outlet 26. Gas is rapidly compressed by a rotary motion of the power core 24 and discharged through the high-pressure air outlet 26.

In an embodiment, the hydraulic fracturing system includes a high-pressure water pump box 1, a water pressure loader 2 is arranged in the high-pressure water pump box 1, and a water pressure monitor 3 is fixedly connected to a top outer wall of the high-pressure water pump box 1, and the water pressure monitor 3 is used for monitoring a water pressure value lifted by the water pressure loader 2. The high-pressure water pump box 1 is communicated with the gas-liquid separation conversion chamber 7 through a high-pressure water pipeline 4, and the gas-liquid pressurization speed-up box 5 is fixedly installed on the high-pressure water pipeline 4.

In an embodiment, the cutting head 13 is provided with a connecting shaft 16, and the power engine 9 is in transmission fit with the cutting head 13 through the connecting shaft 16. An angle adjusting part is arranged between the power engine 9 and the cutting head 13 for controlling a cutting angle of the cutting head 13.

In an embodiment, the angle adjusting part includes a fixed shaft 19 fixedly installed at a top of the power engine 9, where a top end of the fixed shaft 19 is provided with a pin hole, the fixed shaft 19 is hinged with a rocker through the pin hole, and a hinged telescopic cylinder 20 is arranged inside the rocker. A fixed end of the hinged telescopic cylinder 20 is fixedly connected with the rocker, and a moving end of the hinged telescopic cylinder 20 is hinged with the cutting head 13. A middle part of the rocker is hinged with a fixed telescopic cylinder 21, and an end of the fixed telescopic cylinder 21 is fixedly connected with the power engine 9.

The drill pipe 10 used for hydraulic fracturing drilling in the disclosure is the same pipeline as the high-pressure pipeline used in hydraulic fracturing, and the different functions of drilling and hydraulic fracturing are realized by switching the control valves 8 at the gas-liquid separation conversion chamber 7. For example, the control valve 8 of the high-pressure air outlet pipe 18 is opened and the control valve 8 at the gas-liquid separation conversion chamber 7 is closed, so as to realize the pneumatic drilling function. The gas enters the gas-liquid separation conversion chamber 7 through the high-pressure pneumatic motor 17, and enabling the power engine 9 to drive the drill pipe 10 to drill to form a drilling hole required for hydraulic fracturing. On the other hand, the hydraulic fracturing function may be realized by closing the control valve 8 of the high-pressure air outlet pipe 18 and opening the control valve 8 at the gas-liquid separation conversion chamber 7. The liquid enters the gas-liquid pressurization speed-up box 5 through the high-pressure water pump box 1 and the high-pressure water pipeline 4, which further increases a pressure of the fracturing liquid, and then enters the drill pipe 10 through the gas-liquid separation conversion chamber 7 to realize the fracturing function.

As shown is FIG. 1, a use method of the hydraulic fracturing and cutting cooperative device suitable for a hard rock is provided in the disclosure, which includes following steps.

S1, high-pressure gas is generated by the high-pressure pneumatic motor 17 to drive the drill pipe 10 to drill into a hard rock to form a hydraulic fracturing borehole;

S2, the control valve 8 at the gas-liquid separation conversion chamber 7 is adjusted to realize a mutual switching between the pneumatic drilling function and the hydraulic fracturing function of the drill pipe 10;

S3, the high-pressure fracturing fluid is provided through the high-pressure water pump box 1;

S4, when the fracturing fluid flows through the gas-liquid pressurization speed-up box 5, a pressure of the fracturing fluid is further increased by the high-pressure pneumatic motor 17; and S5, an angle of the cutting head 13 is adjusted to perform omni-directional fracturing, and a fractured rock mass is cutting.

According to the disclosure, the hydraulic fracturing function of the high-pressure water pump box 1 is combined with the drilling function of the pneumatic engine through the gas-liquid separation conversion chamber 7 and the gas-liquid pressurization speed-up box 5. After the hard rock is fractured, the hard rock is cut in all directions by adjusting the angle and an excavation depth of the cutting head 13, reducing work steps of hard rock excavation and truly enabling a hard rock excavation process to be an integrated process. The hydraulic fracturing process and the drilling process share the same device, both of which are the drill pipe 10. One end of the drill pipe 10 is communicated with the gas-liquid separation conversion chamber 7, and a work sequence of drilling and hydraulic fracturing of the drill pipe 10 is adjusted by the control valve 8 in the gas-liquid separation conversion chamber 7. By adjusting the hinged telescopic cylinder 20 on the cutting head 13, an excavation angle of the cutting head 13 is controlled, and the angle of the drill pipe 10 for the hydraulic fracturing and the drilling is also changed accordingly, realizing omni-directional integrated drilling fracturing and cutting of the hard rock.

The above is only a preferred embodiment of this disclosure, but the protection scope of this disclosure is not limited to this. Any change or replacement that may be easily thought of by a person of ordinary skill in the art within a technical scope disclosed in this disclosure should be included in the protection scope of this disclosure. Therefore, the protection scope of this disclosure should be based on a protection scope of the claims.

What is claimed is:

1. A hydraulic fracturing and cutting cooperative device suitable for a hard rock, comprising:

a drill pipe, wherein the drill pipe is an integrated drill pipe for hydraulic fracturing and drilling, and one end of the drill pipe is detachably connected with a conical drill bit;

a pneumatic drilling system, wherein the pneumatic drilling system is used for generating high-pressure gas and driving the drill pipe to drill holes;

a hydraulic fracturing system, wherein the hydraulic fracturing system is communicated with the drill pipe and is used for providing high-pressure fracturing fluid;

a collaborative control system, wherein the pneumatic drilling system and the hydraulic fracturing system are both communicated with the collaborative control system, and the collaborative control system is used for realizing mutual conversion of a pneumatic drilling function and a hydraulic fracturing function of the drill pipe; wherein the collaborative control system comprises a gas-liquid pressurization speed-up box and a gas-liquid separation conversion chamber; the gas-liquid pressurization speed-up box is fixedly installed on a console of a roadheader, and the pneumatic drilling system and the hydraulic fracturing system are both communicated with the gas-liquid pressurization speed-up box; the drill pipe is communicated with the gas-liquid separation conversion chamber, and the gas-liquid separation conversion chamber is used for realizing the mutual conversion of the pneumatic drilling function and the hydraulic fracturing function of the drill pipe, and both the pneumatic drilling system and the hydraulic fracturing system are communicated with the gas-liquid separation conversion chamber; and a cutting head, wherein the cutting head is installed on the roadheader, the drill pipe is coaxially sleeved in a middle of the cutting head, and the pneumatic drilling system is in transmission fit with the cutting head.

2. The hydraulic fracturing and cutting cooperative device suitable for a hard rock according to claim 1, wherein the pneumatic drilling system comprises a high-pressure pneumatic motor; the high-pressure pneumatic motor is used for generating high-pressure gas, and the high-pressure pneumatic motor is fixedly installed at a bottom of an inner side of the gas-liquid pressurization speed-up box; one side, close to the gas-liquid separation conversion chamber, of the high-pressure pneumatic motor and a top of the high-pressure pneumatic motor are fixedly communicated with high-pressure air outlet pipes respectively, and the high-pressure air outlet pipes are provided with control valves respectively; and one, close to the gas-liquid separation conversion chamber, of the high-pressure air outlet pipes at the one side of the high-pressure pneumatic motor is communicated with the gas-liquid separation conversion chamber;

one side, away from the high-pressure pneumatic motor, of the gas-liquid separation conversion chamber is communicated with a power engine, and the drill pipe and the cutting head are both in transmission fit with the power engine.

3. The hydraulic fracturing and cutting cooperative device suitable for a hard rock according to claim 2, wherein a top of the roadheader is fixedly connected with a metal bracket protective shell, the gas-liquid separation conversion chamber, the gas-liquid pressurization speed-up box and the console are all arranged in the metal bracket protective shell, and the power engine is fixedly installed on the metal bracket protective shell.

4. The hydraulic fracturing and cutting cooperative device suitable for a hard rock according to claim 2, wherein the high-pressure pneumatic motor comprises a central shaft; an outer side of the central shaft is sequentially sleeved with a power core and a rotating outer ring, and the central shaft comprises a low-pressure air inlet and a high-pressure air outlet.

5. The hydraulic fracturing and cutting cooperative device suitable for a hard rock according to claim 1, wherein the hydraulic fracturing system comprises a high-pressure water pump box; a water pressure loader is arranged in the high-pressure water pump box, and a water pressure monitor is fixedly connected to a top outer wall of the high-pressure water pump box, and the water pressure monitor is used for monitoring a water pressure value lifted by the water pressure loader; the high-pressure water pump box is communicated with the gas-liquid separation conversion chamber through a high-pressure water pipeline, and the gas-liquid pressurization speed-up box is fixedly installed on the high-pressure water pipeline.

6. The hydraulic fracturing and cutting cooperative device suitable for a hard rock according to claim 2, wherein the cutting head is provided with a connecting shaft, and the power engine is in transmission fit with the cutting head through the connecting shaft; an angle adjusting part is arranged between the power engine and the cutting head for controlling a cutting angle of the cutting head.

7. The hydraulic fracturing and cutting cooperative device suitable for a hard rock according to claim 6, wherein the angle adjusting part comprises a fixed shaft fixedly installed at a top of the power engine; a top end of the fixed shaft is provided with a pin hole, the fixed shaft is hinged with a rocker through the pin hole, and a hinged telescopic cylinder is arranged inside the rocker; a fixed end of the hinged telescopic cylinder is fixedly connected with the rocker, and a moving end of the hinged telescopic cylinder is hinged with the cutting head; a middle part of the rocker is hinged with a fixed telescopic cylinder, and an end of the fixed telescopic cylinder is fixedly connected with the power engine.

8. A method of the hydraulic fracturing and cutting cooperative device suitable for a hard rock according to claim 1, comprising the following steps:

S1, generating high-pressure gas by a high-pressure pneumatic motor to drive the drill pipe to drill into a hard rock to form a hydraulic fracturing borehole;

S2, adjusting one of control valves at the gas-liquid separation conversion chamber to realize a mutual switching between the pneumatic drilling function and the hydraulic fracturing function of the drill pipe;

S3, providing high-pressure fracturing fluid through a high-pressure water pump box;

S4, when the fracturing fluid flows through the gas-liquid pressurization speed-up box, further increasing a pressure of the fracturing fluid by the high-pressure pneumatic motor; and S5, adjusting an angle of the cutting head to perform omni-directional fracturing, and cutting a fractured rock mass.

* * * * *